United States Patent [19]

Jaschke et al.

[11] 4,270,931

[45] Jun. 2, 1981

[54] COOLING ARRANGEMENT FOR THE LOCKING DEVICE IN PRESSURE GASIFICATION REACTORS

[75] Inventors: Peter Jaschke, Ossling; Eckhard Mönch; Roland Weber, both of Hoverswerda, all of German Democratic Rep.

[73] Assignee: VEB Gaskombinat Schwarze Pumpe, Schwarze Pumpe, German Democratic Rep.

[21] Appl. No.: 152,576

[22] Filed: May 22, 1980

Related U.S. Application Data

[63] Continuation-in-part of Ser. No. 61,309, Jul. 27, 1979, abandoned.

[30] Foreign Application Priority Data

Jul. 7, 1978 [DD] German Democratic Rep. ... 206576

[51] Int. Cl.[3] ..... C10J 3/30

[52] U.S. Cl. ..... 48/86 R; 48/87; 137/340; 414/204

[58] Field of Search ..... 48/86 R, 57; 414/200–205; 137/340; 266/184; 251/86

[56] References Cited

U.S. PATENT DOCUMENTS

| | | | |
|---|---|---|---|
| 2,414,209 | 1/1947 | Palm | 414/201 |
| 2,575,875 | 11/1951 | Johnson | 137/340 |
| 2,599,334 | 6/1952 | Latham | 414/202 |
| 2,632,697 | 3/1953 | Hubmann | 48/87 |
| 4,129,422 | 12/1978 | Wood | 48/87 |

*Primary Examiner*—Peter F. Kratz

*Attorney, Agent, or Firm*—Michael J. Striker

[57] ABSTRACT

A cooling arrangement particularly for cooling a locking device arranged in a fuel feed opening of pressure gasification generators comprises a lock seat connected to the generator and a lock cone adapted for moving into and out of engagement with the lock seat and provided with a supply line to provide a cooling medium to the lock cone and a discharge line through which the used medium is drained off the lock cone. The lock cone is formed as a hollow body with a cooling chamber in its interior and is provided with guide means extending towards the lowermost area of the lock cone to direct the cooling medium into contact with the mostly overheated lowermost area of the lock cone positioned in a close relationship with the pressure gasification generator.

11 Claims, 4 Drawing Figures

COOLING ARRANGEMENT FOR THE LOCKING DEVICE IN PRESSURE GASIFICATION REACTORS

CROSS-REFERENCE TO RELATED APPLICATION

This application is a Continuation-in-Part of our copending application Ser. No. 61,309 filed July 27, 1979 now abandoned and entitled "Cooling arrangement for the locking device in pressure-gasification reactors".

BACKGROUND OF THE INVENTION

1. Field of the Invention

The present invention relates generally to a cooling arrangement.

More particularly the invention relates to a cooling arrangement for locking devices in pressure-gasification reactors.

The solid-full locks in pressure-gasification reactors normally contain a lock cone situated in a lock-cone seat which is connected to a lock flange. The lock arrangement may be a part of the shutting-off device.

The known lock arrangements such as solid-fuel locks or ash locks mounted particularly in the zone of fuel feed of the pressure-gasification reactors are provided with a channel formed in the jacket of the pressure gasification reactor to receive a cold water which is passed through the reactor jacket.

The cooling effect achieved by so-called water jacket used in the known devices is not sufficient for chilling of all the components of the lock arrangement especially for those which comprise the lock cone and the lock-cone seat mounted on the flange of the pressure gasification reactor because cold water passing within the reactor jacket does not reach the lock arrangement which is normally positioned above the upper surface of the reactor jacket and thus does not fall into the cooling zone provided by the water jacket.

In the known pressure-gasification reactors the lock arrangements are designed for the temperatures up to 673° K. Operational conditions can cause considerably higher temperatures particularly in the zone of fuel feed which, over longer periods of operation may reach a magnitude of 873K. Temperatures rising even above the aforementioned magnitude up to 1.273K. may occur during the operation of the pressure-gasification reactors. Such overheating causes the high thermal stresses on the components of the lock arrangement which may cause considerable deformation on the lock cone and lock-cone seats thereby causing defective sealing between the aforenamed components which leads inevitably to dangerous operative conditions.

SUMMARY OF THE INVENTION

Accordingly, it is an object of the invention to overcome the disadvantages of the prior art.

More particularly, it is an object of the invention to provide an improved cooling arrangement for a locking device in pressure-gasification reactors.

Another object is to provide such a cooling arrangement which makes it possible to bring large quantities of cooling fluid into contact with all the components of the locking device and to guide such cooling fluid into contact with the most possible surfaces of these components in order to obtain highly intensive chilling of the lock arrangement.

These and other objects of the invention are achieved by a cooling arrangement, particularly for cooling lock devices of the pressure-gasification reactors wherein the combination comprises a lock cone and a lock-cone seat, drive means operatively connected to the lock cone to provide a linear movement thereof with respect to the lock seat, for opening and closing the fuel feed opening, a supply line having an end portion and arranged to provide a cooling medium such as water to said lock cone, a discharge line having an end portion and serving to admit the cooling medium and to drain the same off the locking device after this cooling medium is heated in heat exchange with the lock device components; the lock-cone is formed as a hollow body the interior of which forms a cooling chamber. The cooling chamber is connected to the end portion of the supply line and the discharge line respectively and is provided with guide means disposed therein to direct the cooling medium into contact with the mostly overheated area of the lock cone.

Another feature of the invention resides in the provision of the supply and discharge lines which may be pipe lines with torsion loops in order to preclude the damage to the pipe lines movable together with the lock cone in opening or closing operation.

Still another feature of the invention is that the drive means for moving the lock cone are provided with a push rod and a joint ball connected to the lock cone to transmit the movement thereto.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
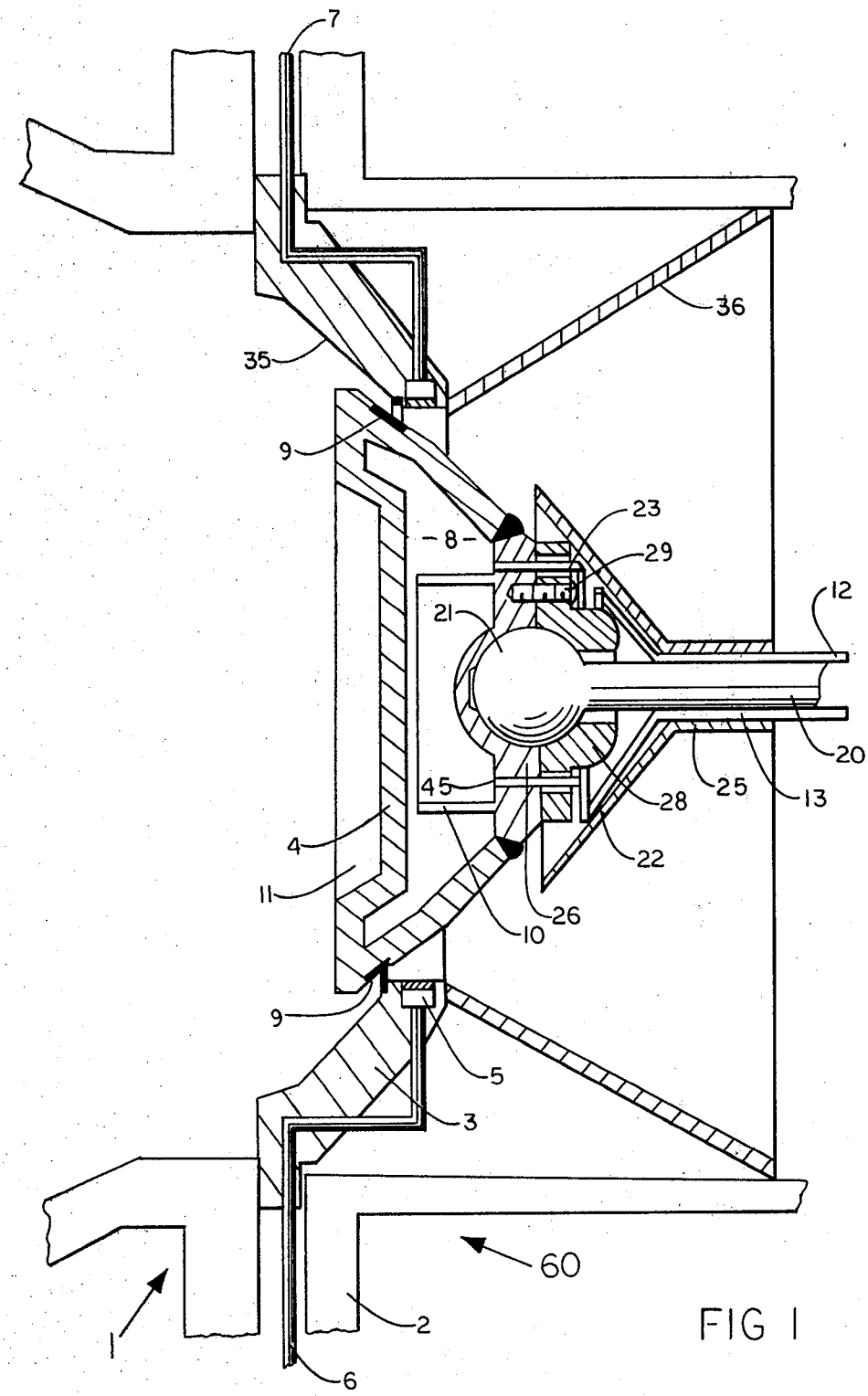
FIG. 1 is a sectional view through a cooling arrangement showing a first embodiment of the invention.
Figure 2:
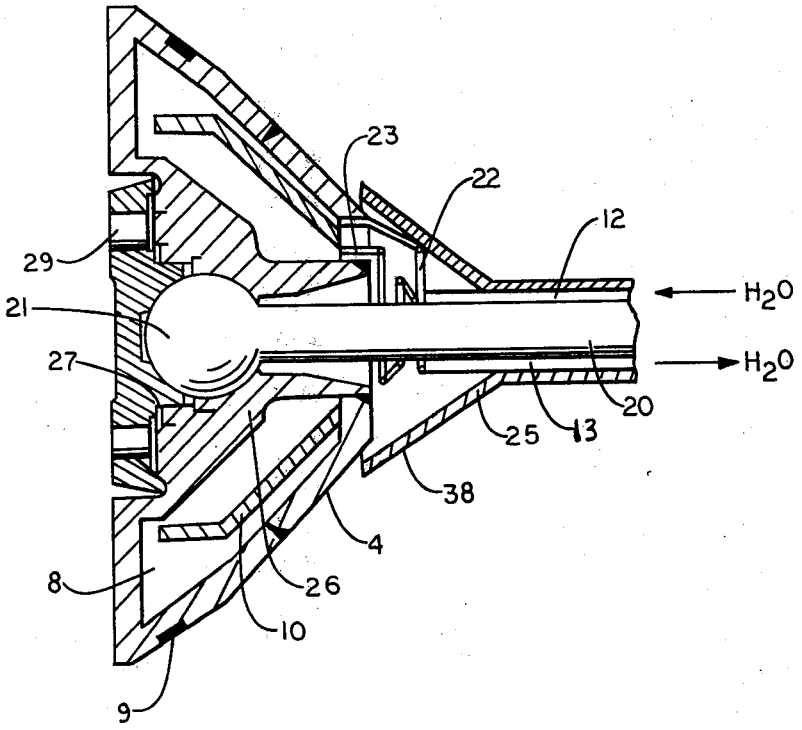
FIG. 2 is a sectional view showing a different embodiment of the invention.
Figure 3:
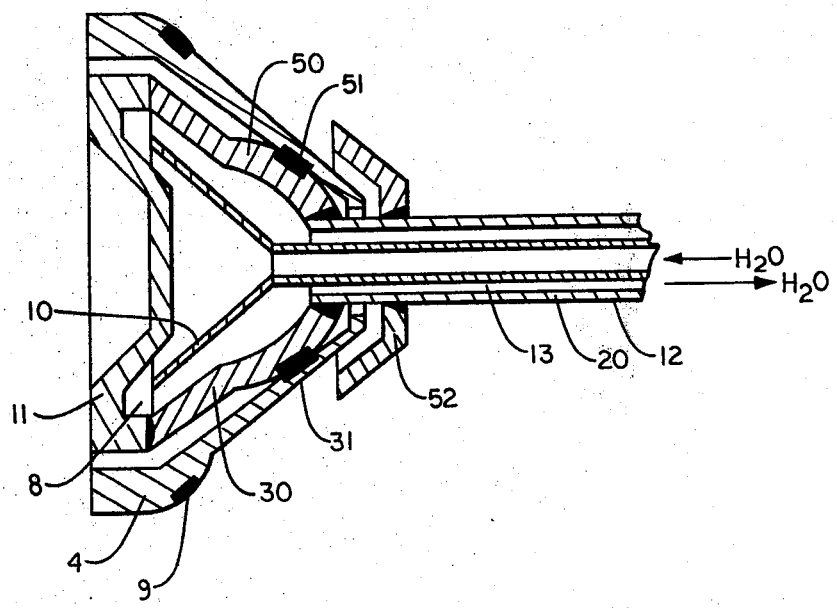
FIG. 3 is a sectional view through another embodiment of the invention.

The cooling arrangement may be described with reference to FIG. 1 for the sake of convenience. The cooling arrangement shown in FIGS. 1–3 is turned through 90°. It is to be understood that the base surface of the lock cone is the lowermost part of the arrangement which is mostly overheated during the operation of the pressure-gasification reactor.

The purpose of the arrangement is to cool a locking device generally denoted as 60 by a cooling water flowing through passages formed in the locking device. The locking device includes a lock cone 4 which is constructed as a hollow cone having an interior which formes a cooling chamber 8. The lock cone 4 is arranged in contact with a lock-cone seat 3 which is located between the flanges of a pressure-gasification reactor 1 and the closure arrangement 2 which are afixed to each other by any conventional fastening means. A circular cooling passage 5 communicated with a water supply conduit 6 and a water discharge conduit 7 are formed in the lock-cone seat 3. Sealing elements 9 are arranged between the lock cone 4 and the cone-seat 3 which are specifically subjected to overheating under influence of high temperatures occured in the pressure-gasification reactor during operation since the sealing elements are positioned in the lower-most area designated as 11 of the locking device located above the heating zone of the reactor.

The cooling fluid such as water for cooling the lock cone 4 is fed into the chamber 8 via a supply line or passage 12 provided within a tubular member 25 to communicate a source of the cooling fluid (not shown) with the locking arrangement. A discharge or return line 13 is arranged in the tubular member 25 through which the cooling fluid is drained off the locking arrangement after it is heated in contact with the locking arrangement parts.

Figure 4:
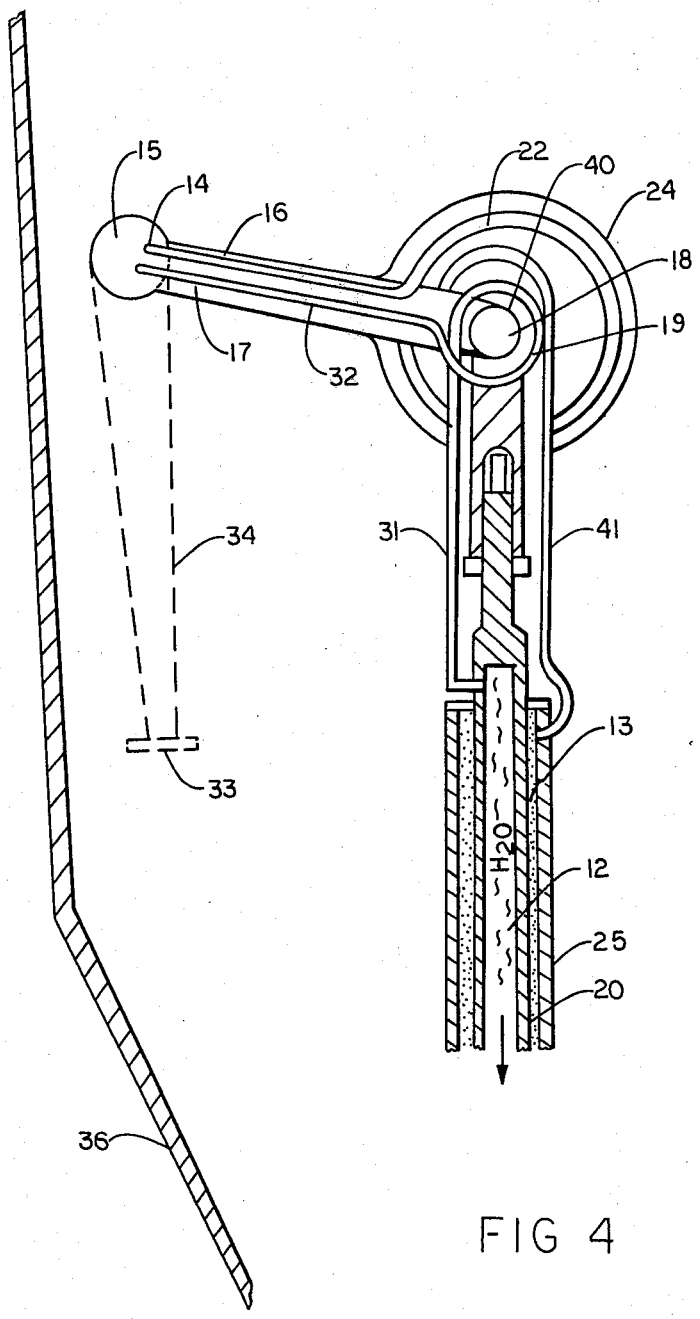
FIG. 4 is a sectional view through a hollow shaft of the lock cone and a joint for linking the lock cone connected thereto suitable for each embodiment of the invention.

As can be seen in FIG. 4 the supply line or passage 12 is connected via a pipe 31 to a conduit 32 which in turn is associated with a cooling fluid supply source (not shown). The tubular element 25 is fixedly connected to a push rod 20 which in turn is connected to a pin 18 of a joint 40 arranged between the push rod 20 of the locking device and a lever 17 which is pivotally mounted on the pin 18 with its one end and fixedly connected to a drive shaft 15 with its other end. The drive shaft 15 is adapted to be rotated by any conventional means, as for example by means of a motor 33 and a chain 34 shown in FIG. 4 to cause a swingable movement of the lever 17 operative to provide a reciprocating movement of the push rod 20 along with the cone lock 4 in order to open and close a fuel feed opening 35 formed by lock walls 36. The connection between the lock cone and the push rod will be explained in detail below. The pipe 31 is provided with a torsion coil 19 wound about the joint 40 and terminated in the pipe 32. The discharge passage 13 is connected to a pipe 41 which is provided with a torsion loop 22 connected to a pipe 16 which is associated with any conventional drain arrangement which admits the cooling medium after its usage. The torsion loops have lengths at a minimum of 100 times the pipe diameter, and have a radius of curvature of a minimum of 10 times the pipe diameter. The provision of the cooling arrangement with the torsion loops in both supply line and discharge line of the arrangement permits the device to be accomodated for the movement of the push rod 20 and the joint 40 during the opening and closing movement of the locking device without damage to the pipes. Pipes 16 and 32 may be formed from any conventional suitable deformable material. In order to protect the coils 19 and 22 against being mechanically affected by the fuel, the torsion coils are covered by a shield 24.

Referring to FIG. 1 which illustrates the first embodiment of the invention, it can be seen that the push rod 20 is terminated in this construction with a ball joint 21 which is disposed in contact with a socket 26 and a cover 28. The supply line 12 shown as an upper conduit located in the tubular element 25 is connected with the chamber 8 via a nozzle 23 arranged in a bore going through the cover 28 and the socket 26 which are fixedly connected to each other by means of threaded bolts 29. The discharge line 13 shown in this embodiment as a lower conduit disposed in the tubular element 25 terminates in a channel 45 connected to the cooling chamber 8. In order to provide the most possible surfaces of the lock cone 4 with the cooling fluid the socket 26 is provided with a guide vane 10 extending into the interior of the chamber 8 which directs the cooling water flow during cooling operation and serves to increase the flow velocity of the cooling water. The guide vane 10 in this embodiment of the cooling arrangement are of substantially cylindrical shape. The ball joint 21 in this embodiment connects the push rod 20 with the cone lock body and transmits the opening and closing movement of the push rod operatively connected to the drive shaft 15 to the lock cone 4.

The lock cone 4 depicted in FIG. 2 illustrating another embodiment of the invention includes a push rod 20 with a ball joint 21 positioned in two adjoining hemispherical openings formed in a cover 27 and in a socket 26 respectively. The embodiment in FIG. 2 is similar to that shown in FIG. 1. However, the non-cooled cover 27 in this construction is arranged on the outer side of the lock cone 4. The guide vane 10 extends towards the lowermost area of the lock cone 4 and is of a substantially cup-shaped form. The tubular element 25 is provided with a conical end portion 38 which serves as a shield for the pipe loop 22 of line 12 which in this structure may be located in the lower part of the tubular element 25. The nozzle 23 directs the cooling fluid into the cooling chamber 8. This embodiment is suitable for lock-cones of small diameters and for moderate raw gas temperatures, and has the advantage that the attachment of the reactor flange to the lock-cone is not subjected to stress caused by the force operating the lock cone 4.

For the lock cones of large diameters the structure shown in FIG. 3 is appeared to be mostly suitable. A pilot cone 30 having a spherical rearside surface 50 is positioned within the lock cone 4 and provided with a chamber 8. The supply line is in this embodiment formed by a tubular element 12 located within the tubular member 20 with a clearance which serves as the discharging passage 13. The tubular member 12 terminates with a guide vane 10 extending into the cooling chamber 8 and being of a substantially conical shape. Seals 51 are located between the spherical outer surfaces of the pilot cone 30 and the inner surfaces of the lock cone 4 which have lens-shaped cross-sections. The lowermost area 11 is cooled in a manner similar to that described for FIG. 1. A hollow truncated cone 52 fixedly connected to the push rod 20 which is a tubular member in this structure, transmits the movement to the lock cone 4.

It should be understood that the lower surface area 11 of the lock cone exposed to the direct radiant heat of the pressure gasification reactor, will be heated up very severely and it is therefore very desirable to cool the lateral and bottom sealing devices provided in the lower area of the cone lock and subjected to the great damage due to overheating. All the embodiments disclosed herein include a provision of guide means distantly extending towards the lower mostly overheated zone of the lock cone.

The invention persues the task of precluding excessive temperatures in the locking device components by water-cooling of the stationary and movable components of the lock to thereby reduce the tendency of the lock components to malfunction and increase the operational safety of the plant. It will be understood that each of the elements described above, or two or more together, may also find a useful application in other types of cooling arrangements for locking devices of pressure-gasification reactors differing from the types described above.

While the invention has been illustrated and described as embodied in a cooling arrangement of the foregoing type, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed as new and desired to be protected by Letters Patent is set forth in the appended claims:

1. A cooling arrangement, for cooling a locking device arranged in a fuel feed opening of a pressure gasification generator for gasification of solid fuel, the combination comprising a lock seat connected to the generator; a lock cone having a lowermost area positioned in a close relationship with the generator; drive means operatively connected to said lock cone to provide a linear movement of said lock cone with respect to said lock seat for opening and closing the fuel feed opening; a supply line to provide a cooling medium to said lock cone; said supply line having an end portion; a discharge line to drain the cooling medium after the latter is heated in heat exchange with the lock device components, said discharge line having an end portion, said lock-cone being formed as a hollow body to form a cooling chamber, said cooling chamber being connected to said end portions of said supply line and said discharge line respectively; and guide means arranged within said cooling chamber and extending toward said lowermost area to direct the cooling medium into contact with said lowermost area of said lock cone, wherein said supply line and said discharge line are pipe lines and said drive means includes support means for supporting said pipe lines for their respective movement along with said lock cone in said linear movement thereof, and wherein said pipe lines are provided with torsion loop portions to preclude said pipe lines from damage when the latter are deformed during the movement of the lock cone.

2. The cooling arrangement of claim 1, wherein said guide means is a vane of a substantially cylindrical shape.

3. The cooling arrangement of claim 1, wherein said guide means is a vane of substantially conical shape.

4. The cooling arrangement of claim 1, wherein said guide means is a vane having a cup-shaped cross-section.

5. The cooling arrangement of claim 1, wherein said torsion loops have lengths at a minimum of 100 times the pipe diameter, and have a radius of curvature of a minimum of 10 times the pipe diameter.

6. The cooling arrangement of claim 1, further comprises shield means arranged to cover said torsion loops for protecting the same from affecting by the fuel.

7. The cooling arrangement of claim 1, wherein said drive means include a push rod and a ball joint connected thereto, said ball joint being connected to said lock cone and arranged to transmit said linear movement to said lock cone.

8. The cooling arrangement of claim 7, further including a cover and a socket arranged in said lock cone, said cover and said socket being arranged to receive said ball joint.

9. The cooling arrangement of claim 1, wherein said drive means include a pilot cone mounted within said lock cone and connected thereto, and a tubular member connected to said pilot cone, said tubular member being adapted to accomodate said end portion of said supply line and said discharge line and to transmit said linear movement to said lock cone.

10. The cooling arrangement of claim 9, further comprising seals arranged between said pilot cone and said lock cone.

11. The cooling arrangement of claim 1, wherein said lock seat is provided with a cooling passage, a supply channel to receive a cooling medium and a discharge channel to drain a cooling medium off the lock seat, said cooling passage being associated with said supply channel and said discharge channel.

* * * * *